US006639568B1

(12) United States Patent
Hartmann

(10) Patent No.: US 6,639,568 B1
(45) Date of Patent: Oct. 28, 2003

(54) METHOD FOR ADJUSTING PARABOLIC ANTENNAE

(76) Inventor: Rainer Hartmann, Lindenstrasse 5, Friolzheim (DE), D-71292

( * ) Notice: Subject to any disclaimer, the term of this patent is extended or adjusted under 35 U.S.C. 154(b) by 29 days.

(21) Appl. No.: 10/049,341

(22) PCT Filed: Jul. 20, 2000

(86) PCT No.: PCT/DE00/02366

§ 371 (c)(1),
(2), (4) Date: Feb. 11, 2002

(87) PCT Pub. No.: WO01/11714

PCT Pub. Date: Feb. 15, 2001

(30) Foreign Application Priority Data

Aug. 9, 1999 (DE) ..... 199 37 511

(51) Int. Cl.[7] ..... H01Q 1/12
(52) U.S. Cl. ..... 343/892; 343/878
(58) Field of Search ..... 343/892, 878, 343/894, 757, 760, 765, 766, 880, 882, 840

(56) References Cited

U.S. PATENT DOCUMENTS 4,672,385 A * 6/1987 Prindle ..... 343/766
4,689,635 A * 8/1987 Haupt ..... 343/894
5,977,922 A * 11/1999 Hemmingsen, II ..... 343/760

FOREIGN PATENT DOCUMENTS

EP 038 788 10/1981 ..... H01Q/1/12

* cited by examiner

*Primary Examiner*—Hoang Nguyen
(74) *Attorney, Agent, or Firm*—Ostrolenk, Faber, Gerb & Soffen, LLP

(57) ABSTRACT

A method for adjusting a parabolic antenna with a reflector attached to a bracket, the reflector being designed as at least part of a paraboloid and with a receiving device located essentially at a focus of the reflector. The method includes the steps of adjusting the bracket with a measuring device installed in the bracket without need for the reflector to be attached to the bracket, and subsequently detachably fastening the reflector to the bracket.

9 Claims, 1 Drawing Sheet

METHOD FOR ADJUSTING PARABOLIC ANTENNAE

PRIORITY CLAIM

This is a national stage of application No. PCT/DE00/02366, filed on Jul. 20, 2000. Priority is claimed on that application and on the following application:

Country: Germany, Application No.: 199 37 511.9, Filed: Aug. 9, 1999.

BACKGROUND OF THE INVENTION

The invention pertains to a method for adjusting parabolic antennas mounted on brackets and to a mounting device for parabolic antennas.

Parabolic antennas are mounted on buildings, masts, etc., and pointed at the satellites from the which desired signals are to be received. These antennas are usually installed in exposed positions such as on roofs, on the exterior walls of houses, etc., and then aligned with the signals coming from the satellite, the antenna being rotated and tilted until the signal is received at maximum intensity by the receiving device located at the focus of the parabolic antenna. Especially in the case of large parabolic antennas, this installation procedure is cumbersome and complicated and is often associated with risk.

SUMMARY OF THE INVENTION

The task of the invention is therefore to improve the process for adjusting parabolic antennas mounted on brackets and to improve the mounting device for parabolic antennas in such a way that such antennas can be installed and aligned with a satellite very easily, even in exposed and difficult-to-reach places.

Pursuant to the present invention, the method for adjusting a parabolic antenna with a reflector attached to a bracket includes the steps of adjusting the bracket by means of a measuring device installed in the bracket without the need for the reflector to be attached to the bracket, and subsequently detachably fastening the reflector to the bracket. A mounting device pursuant to the present invention for a parabolic antenna is comprised of a bracket, fastening elements mounted on the bracket for attaching the parabolic antenna, a receiving device, and a measuring device operative to detect satellite signals. The measuring device is integrated into the bracket and the parabolic antenna is attachable to the fastening elements without tools.

Integrating a measuring device for detecting the satellite signals into the bracket offers the significant advantage that the mounting device can be aligned with the satellite signal before the reflecting device is attached. In conjunction with fastening elements, which make it possible for the reflector to be attached without tools and also detached easily again, the entire satellite receiving device can be easily aligned to receive the satellite signal at maximum intensity and then fastened in place. In particular, there is no longer any need to subject the parabolic antenna itself to cumbersome manipulations.

It is possible in principle to provide a second, small receiving device in the bracket, which can be used to align the bracket with the satellite signal. In addition, however, the receiving device which will ultimately be positioned essentially at the focus of the reflector can be integrated temporarily into the mounting bracket and used to align the bracket with the satellite signal. After the alignment has been completed, the receiving device is removed from the bracket and installed at the focal point of the reflector.

It is also possible for a part of the bracket to be provided with a paraboloid surface, so that a receiving device, which will ultimately be installed at the focal point of the reflector, can work with this paraboloid surface to faclitate the adjustment procedure.

In an advantageous embodiment, it is provided that the measuring instrument is integrated on a chip, which means that it will occupy only a very small amount of space. In another advantageous embodiment, furthermore, solar cells are provided on the bracket, which supply the measuring device with power. In this way, no additional power supply units which would have to be connected by power cords are needed.

The fastening elements for the parabolic antennas are preferably designed as rails, in which sliding elements on the back of the parabolic antenna engage. The parabolic antenna can thus be mounted by sliding it onto the rails; it can also be removed again just as easily. As a result, it is easy to remove the parabolic antenna so that it can be replaced with an antenna of a different design, for example.

Additional features and advantages of the invention are the objects of the following description and are illustrated in the drawings, which show an exemplary embodiment.

BRIEF DESCRIPTION OF THE DRAWINGS

The FIGURE shows a schematic diagram of an exemplary embodiment of a mounting device which makes use of the invention.

DETAILED DESCRIPTION OF THE PREFERRED EMBODIMENTS

Figure 1:
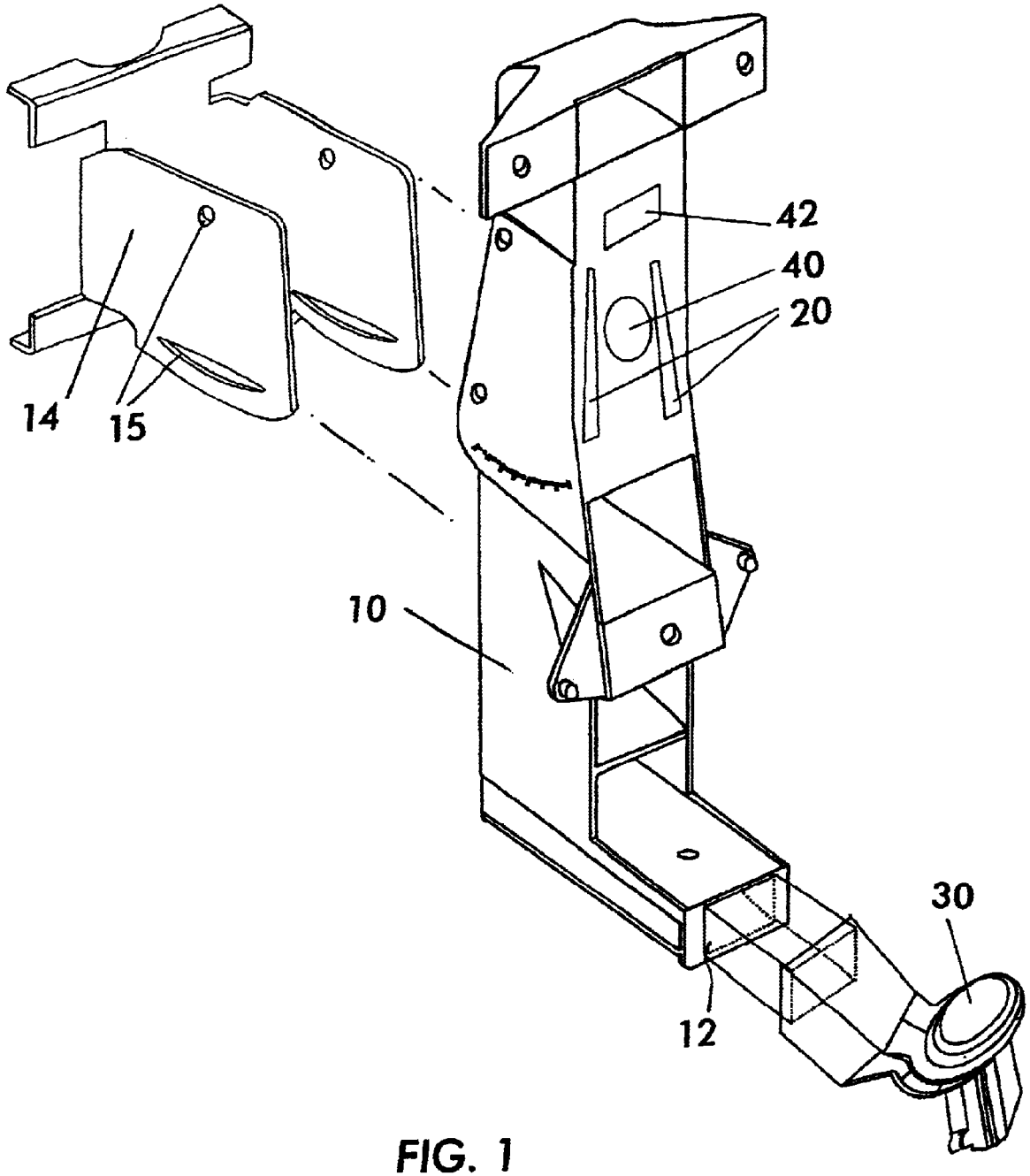

A mounting device for parabolic antennas comprises a bracket 10, to which a reflector (not shown) in the form of a paraboloid or part of a paraboloid can be attached. Fastening elements 20, which can be designed, for example, as rails, as shown here, are provided on the bracket 10. Sliding elements (not shown) attached to the back of the reflector can slide along these rails and thus serve to hold the reflector in position. A receiving device 30 with a receiver for satellite signals can also be attached to the bracket 10; this can be done, for example, by inserting it into an opening 12 in the bracket 10.

The receiving device 30, the appearance of which is distorted in the FIGURE, is located essentially at what will be the focal point of the reflector after the reflector has been mounted. It receives the satellite signals reflected and focused by the reflector.

The bracket 10 is attached, for example, to a mast bracket 14. As can be seen from the FIGURE, the mast bracket 14 has holes 15 and slots 16 to allow the antenna bracket to be attached to it, so that the tilt angle of the antenna bracket 10 can be adjusted. The mast bracket 14 itself is mounted rotatably on a rod-like mast, which allows the reflector to be pointed at a satellite. A measuring instrument 40 is integrated into the bracket 10, which instrument makes it possible to align the bracket 10 with the satellite, so that the signals can be received at maximum intensity. The measuring instrument 40 is integrated into the bracket 10 in such a way that, when the instrument 40 detects the satellite signal at maximum intensity, this same maximum intensity signal will also be received by the parabolic antenna to be attached later. Expressed in another way, the measuring instrument 40 is located so that, after the bracket 10 has been aligned to receive the satellite signal at maximum intensity, the main receiver will also receive this signal after the reflector has been installed. This measuring instrument 40 can be a second, small measuring or receiving instrument for satellite signals, but the receiver which forms part of the main receiving device 30 can also be integrated into the bracket for the adjustment procedure and then reinstalled in the receiving device 30 later, after the bracket has been adjusted. In this case, a part of the bracket 10 can be designed as a paraboloid or as part of a paraboloid and thus represents so to speak a miniaturized reflector for the adjustment of the bracket.

Solar cells 42 are also provided on the bracket 10 to supply the measuring instrument 40 with power. As a result, there is no need for any power supply cords.

The bracket and the reflector are mounted in the following way:

First, the bracket 10 is attached to the mast holder 14 and aligned with the satellite to receive its signals at maximum intensity with help of the measuring instrument 40.

Then the bracket 10 is fastened to the mast holder, and the mast holder is fastened to the mast.

Next, the reflector is attached by sliding it into the holding rails 20.

The mounting device described above for parabolic antennas offers not only the significant advantage that it can be installed much more conveniently and easily than the mounting devices known from the state of the art, which must always be aligned with the satellite to receive signals at maximum intensity while the reflector is attached to the device. Because the reflector is attached without tools, furthermore, it is also possible to remove the paraboloid-shaped reflector or a reflector of some other shape easily and to replace it with a unit of a different design. This can be advantageous for advertising purposes, for example, but it is also useful for adapting the system to new sets of conditions such as a change in the color of the exterior wall, a change in the color of the roof of the building, etc.

What is claimed is:

1. A mounting device for a parabolic antenna, comprising:

a bracket;

fastening elements mounted on the bracket for attachment of the parabolic antenna;

a receiving device; and a measuring device operative for detecting satellite signals, the measuring device being integrated into the bracket, the parabolic antenna being releasably attachable to the fastening elements without tools.

2. A mounting device according to claim 1, wherein the measuring device is mounted to an area of the bracket formed as at least a part of a paraboloid.

3. A mounting device according to claim 1, wherein the measuring instrument is integrated on a chip.

4. A mounting device according to claim 1, and further comprising solar cells mounted on the bracket so as to provide the measuring device with power.

5. A mounting device according to claim 1, wherein the measuring device and the receiving device are a single component.

6. A mounting device according to claim 1, wherein the fastening elements are rails in which sliding elements on a back of the parabolic antenna engage.

7. A method for adjusting a parabolic antenna with a reflector attached to a bracket, the reflector being designed as at least part of a paraboloid and with a receiving device located essentially at a focus of the reflector, the method comprising the steps of:

adjusting the bracket with a measuring device installed in the bracket without need for the reflector to be attached to the bracket; and subsequently detachably fastening the reflector to the bracket.

8. A method according to claim 7, including using a receiver of the receiving device as the measuring device.

9. A method according to claim 8, including attaching the receiving device to the bracket, and using a part of the bracket, designed as at least a part of paraboloid, as a reflector.

* * * * *